US005371374A

United States Patent [19]

Fritzson

[11] Patent Number: 5,371,374

[45] Date of Patent: Dec. 6, 1994

[54] OPTICAL SENSOR HAVING A SHIELDING ELEMENT FOR PREVENTING RECEPTION OF UNDESIRABLE REFLECTED LIGHT

[75] Inventor: Joachim Fritzson, Ulricehamn, Sweden

[73] Assignee: IRO AB, Ulricehamn, Sweden

[21] Appl. No.: 66,132

[22] PCT Filed: Nov. 22, 1991

[86] PCT No.: PCT/EP91/02207

§ 371 Date: May 25, 1993

§ 102(e) Date: May 25, 1993

[87] PCT Pub. No.: WO92/09516

PCT Pub. Date: Jun. 11, 1992

[30] Foreign Application Priority Data

Nov. 26, 1990 [DE] Germany ..... 4037575

[51] Int. Cl.[5] ..... G01V 9/04

[52] U.S. Cl. ..... 250/561; 356/429

[58] Field of Search ..... 250/561, 562, 571, 572, 250/563; 356/429, 430, 432, 238; 19/0.21; 28/187; 57/81; 66/158; 139/273 A, 336; 242/37

[56] References Cited

U.S. PATENT DOCUMENTS

| | | | |
|---|---|---|---|
| 3,430,426 | 3/1969 | Bryan, Jr. et al. . | |
| 3,631,901 | 1/1972 | Langenbach | 250/563 |
| 4,313,472 | 2/1982 | Weidmann | 139/370.2 |
| 4,643,230 | 2/1987 | Aemmer et al. | 250/563 |
| 4,772,800 | 9/1988 | Kanai et al. | 250/561 |
| 4,857,749 | 8/1989 | McCarty | 356/429 |
| 4,990,793 | 2/1991 | Bönigk et al. | 356/238 |

FOREIGN PATENT DOCUMENTS

| | | |
|---|---|---|
| 0327973 | 8/1989 | European Pat. Off. . |
| 2447416 | 8/1980 | France . |
| 2528882 | 12/1983 | France . |
| 57-77328 | 5/1982 | Japan . |
| 55-151233 | 5/1982 | Japan . |
| 55-153761 | 5/1982 | Japan . |
| 2123140A | 1/1984 | United Kingdom . |
| WO90/06504 | 6/1990 | WIPO . |

*Primary Examiner*—David C. Nelms
*Assistant Examiner*—Stephone B. Allen
*Attorney, Agent, or Firm*—Flynn, Thiel, Boutell & Tanis

[57] ABSTRACT

In the case of an optical sensor, which is used for a thread (Y) moving approximately transversely to the longitudinal direction thereof, in particular for the thread supply (V) which consists of non-separated thread windings in a thread storage and feed device (F) having provided therein a light source (2) directed towards a predetermined passage area (P) for the thread (Y) and a receiver (3) oriented such that scattered light (6) reflected by the thread in said passage area will fall onto it, a shield element (9), (10) is arranged in the passage area (P) below the thread (Y) on the side of the thread which faces away from the light source (2), said shield element being arranged and/or constructed in such a way that it will not reflect light (4), which comes from the light source (2), to the receiver (3) and that it will not allow light, which is reflected by surfaces or objects (L) located on the other side of the shield element (9) with respect to the light source (2), to pass to the receiver (3).

10 Claims, 1 Drawing Sheet

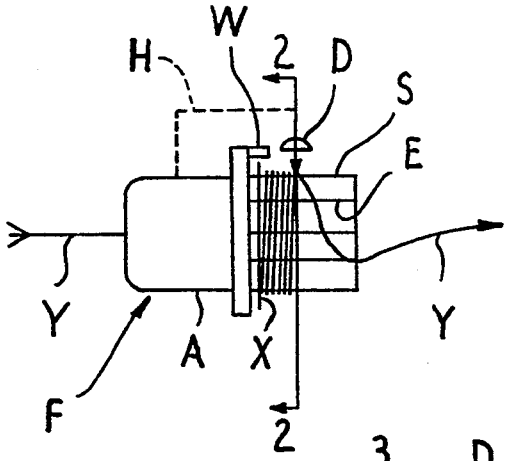
FIG. 1
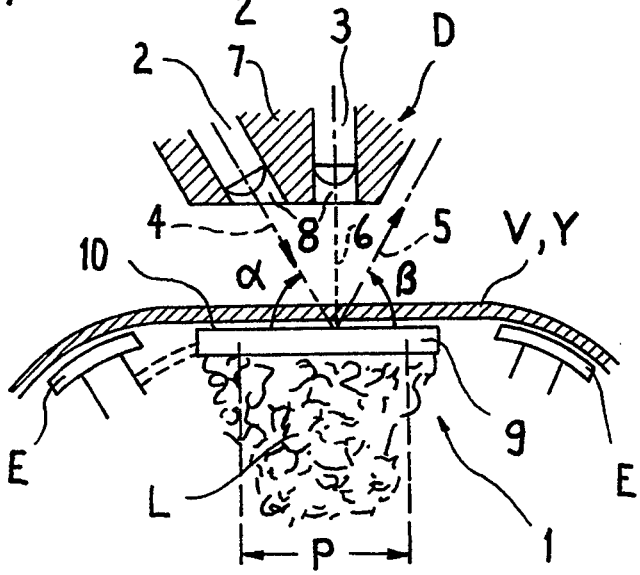
FIG. 2
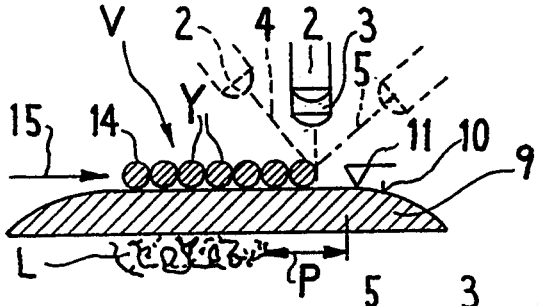
FIG. 3
FIG. 4
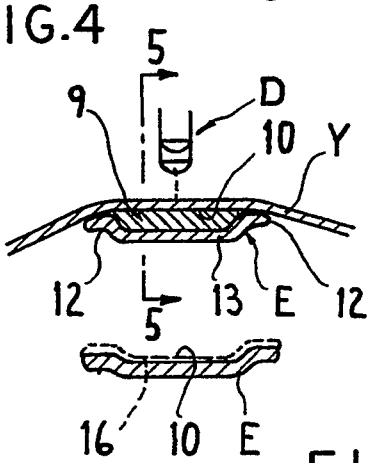
FIG. 6
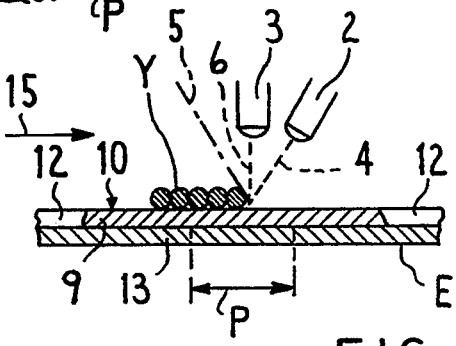
FIG. 5

OPTICAL SENSOR HAVING A SHIELDING ELEMENT FOR PREVENTING RECEPTION OF UNDESIRABLE REFLECTED LIGHT

The present invention refers to an optical sensor for a thread storage and feed device, and more particularly, to an optical sensor having a shield element interposed between a receiver and surfaces or objects associated with the thread storage and feed device to prevent the surfaces or objects from reflecting undesirable light to the receiver.

BACKGROUND OF THE INVENTION

As soon as the thread enters the passage area transversely to its longitudinal direction, it will reflect part of the incident light in essentially undefined directions due to its three-dimensional shape and its irregular surface. Part of the light reflected will fall on the receiver, which will then produce a signal representative of the presence of the thread. On the other hand, the sensor can also be constructed such that the receiver will produce a signal representative of the absence of the thread, when no thread is present. Especially in a thread storage and feed device in which a thread supply consisting of non-separated thread windings is produced and advanced approximately transversely to the longitudinal direction of the thread, the sensor will, for example, scan the size of the thread supply so as to be able to control with the aid of the signals produced during such scanning either the supplementation of the thread supply or an interruption of the supplementation of the thread supply (maximum sensor). It is, however, just as well possible to detect by means of the sensor the moment at which the thread supply has reached a predetermined reference position on the storage surface and to derive a signal therefrom (reference sensor). The reliability of the sensor depends on the possibility of producing strong and unequivocal signals on the basis of the presence or absence of the thread, and, in this respect, the reliability has hitherto been impaired by interfering optical influences in or at the passage area. Such interfering influences may by lints, which can not practically be avoided when threads are being processed, or some type of surfaces or objects which, from the incident light reflect light which falls onto the receiver.

In the case of an optical sensor, which is provided in a thread storage and feed device and which is known from EP-A1-03 27 973, the element whose surface is in contact with the thread is a reflector consisting of a reflective strip embedded between light-transmitting glass layers. The reflector is positioned in an axially extending cavity of a finger of the finger or rod cage. The light source is combined with a receiver responding to that part of the light of the light source which is reflected by said reflector and using reflected light variations, which are caused by the thread passing through, for the purpose of signal generation. Scattered light reflected by the thread or by lints or by extraneous elements is, in comparison with the light reflected by the reflector, too weak for generating a signal. However, lints or other extraneous elements in the passage area may cause the same reflected light variation as the thread, and, consequently, they may result in an incorrect signal.

In the case of an opto-electronic sensor provided in a thread storage and feed device and known from WO90/06 504, a sharply defined image of the thread in the passage area is produced by means of depth of field limitation with the aid of an image-forming optics and is then used for signal generation, said forming of an image and said signal generation being carried out irrespectively of whether there is any surface on the passage area side facing away from the light source and, if this is the case, irrespectively of the kind of surface. On the contrary, the scattered light reflected by the thread from the light of the light source is used for producing the sharp image.

In the case of an opto-electronic sensor of a colour selector of a multicolour weaving machine (FR-A-24 47 416), the colour selector enveloping surface, which is arranged behind the thread, is black or provided with a black covering so that no reflected light will be guided to the receiver. The thread moves in the longitudinal direction and above the enveloping surface in spaced relationship therewith.

The Patent Abstracts of Japan, Vol. 6, No. 158 (C-120) (1036), Aug. 19, 1982, discloses that, upon spinning a thread from fibres, the difference in the scattered light reflection between a thread running regularly through a suction tube in the longitudinal direction and fibre tufts passing through said tube after breaking of the thread is scanned for the purpose of detecting malfunction. The interior wall of the suction tube is black so that any light originating from a light source, which is directed onto the suction tube through a slot in the tube wall, will be absorbed.

U.S. Pat. No. 3,430,426 discloses that, in the case of an optical sensor in a spinning frame, a black body is provided as a background wall, said black body reflecting little, or no light at all to a group of receivers for supervising thus the correct operation of the spindles.

The present invention is based on the task of providing a sensor of the type mentioned at the beginning by means of which incorrect signals caused by light reflected by objects other than the thread are avoided.

According to the invention, due to the light-absorbing structural design of the surface of the element, only reflected scattered light from the thread will fall onto the receiver, which will derive strong and unequivocal signals from the presence or from the absence of the thread in the passage area. The fact that the element is constructed as a shield element prevents the generation or transmission of light reflected by surfaces or objects other than the thread, which are located on the other side of the passage area, and falling onto the receiver, so that no incorrect signals will be generated. Especially in thread storage and feed devices, lints or lint tufts will accumulate in unavoidable cavities of the rod or finger cage; said lints or lint tufts have a reflection behaviour which is similar to that of the thread itself, and they may emit, from the light coming from the light source, reflected scattered light resulting in incorrect signals. The shield element shields off dirt, which may perhaps be present in the passage area and behind the thread (lints, lint tufts or extraneous dirt), or reflecting surfaces, so that light from the light source will not fall onto said dirt or reflecting surfaces. Also light which has been generated in some other way and which is, in principle, directed onto the receiver is prevented from falling onto said receiver. It is true that the shield element does not generate any direct and strong reflected light at its light-absorbing surface; since, however, even light-absorbing surfaces generate, in practice, still some amount of reflected light, the receiver will be arranged outside of the area of the scattered light reflected by the surface, and light reflected by objects other than the thread will thus be prevented from being applied to the receiver in an undesirable manner. Dirt is prevented from adhering to the surface, since said surface is permanently cleaned by the thread.

In one embodiment, the reflected light, which cannot be avoided at the light-absorbing surface, will reliably bypass the receiver so that said receiver can concentrate on the scattered light reflected by the thread and so that it will produce its signals only in the presence or in the absence of the thread. A very distinct signal transition (signal shape) between the presence and the absence of the thread is achieved, and this will facilitate the evaluation of the signals.

In the invention, a plastic plate can easily be accommodated in the thread storage and feed device below the passage area.

Also in the invention, the lints, lint tufts or extraneous dirt, which will inevitably accumulate in the cavity, will have no chance of generating reflected light from the light of the light source. Light which does not originate from the thread and which is directed towards the receiver from below in some other way will be shielded off as well.

Further in the invention, the surface will only generate reflected light having an oblique exit angle—if it generates any reflected light at all due to the oblique incident angle of the light. Due to the fact that the receiver is arranged perpendicularly to the surface of this antimirror (blind mirror) and above the area in which the light falls onto the surface, this reflected light will bypass the receiver. At least part of the unoriented reflected light of the thread will, however, fall onto the receiver in the predetermined way. The scanning direction perpendicularly to the longitudinal direction of the thread results in a distinct and easily scannable signal transition (signal shape) at the receiver. However, in specific cases of use, a scanning direction parallel to the longitudinal direction of the thread or even obliquely to said longitudinal direction may be expedient. In practical operation, the respective scanning direction chosen will be determined by the space conditions and by the possibilities of applying a strong reflected light component from the thread to the receiver.

In another aspect of the invention, the thread causes permanent automatic cleaning of the light-absorbing surface so that the light-absorbing properties will be preserved for a long time. Furthermore, the thread is precisely guided on the surface during the scanning operation.

Alternatively, the fibres sweeping over the surface suffice to produce the cleaning effect, whereas the thread itself is not subjected to any perceptible frictional forces.

In another aspect of the invention, the shield element permits light which comes from the light source to pass, whereas, in the opposite direction, it does not permit such passage of light. This has the effect that a particularly effective light absorption is achieved. The shield element is constructed similar to the glasses of a mirrorred pair of sunglasses.

BRIEF DESCRIPTION OF THE DRAWINGS

Embodiments of the subject matter of the present invention are explained on the basis of the drawings, in which:

FIG. 1 shows a schematic side view of a thread storage and feed device,

FIG. 2 shows part of an enlarged radial section in FIG. 1,

FIG. 3 shows a sectional side view of FIG. 2,

FIG. 4 shows part of a radial section through a different embodiment,

FIG. 5 shows a sectional side view of FIG. 4, and

FIG. 6 shows a variation of a detail of FIG. 4.

DETAILED DESCRIPTION

A thread storage and feed device F according to FIG. 1 comprises a drive member A and an e.g. stationary storage surface S having the shape of a drum, a thread supply V being adapted to be formed on said storage surface from an axially passing thread Y by means of a winding member W which is adapted to be driven such that it rotates. The storage surface S is constructed e.g. as a rod or finger cage whose axial fingers E are circumferentially spaced. A feed element X serves to advance the thread windings, which are formed on the storage surface S by the winding member W, from the left-hand to the right-hand side in FIG. 1. Within the thread supply V, the thread windings abut on one another without any interspaces. An optical sensor D is attached in a stationary manner to a holding device H of the housing, or it is attached in some other way, said optical sensor being directed towards the storage surface S from outside and scanning e.g. the front-end boundary of the thread supply V so as to be able to maintain a specific size of said thread supply (number of windings). As soon as the sensor D detects the presence of the front-end boundary of the thread supply V, the drive of the winding member W will be deactuated (maximum sensor). If, due to a consumption of thread, the boundary of the thread supply V migrates to the left in FIG. 1, the drive of the winding member W will be reactuated by an adequate signal of the sensor D until the predetermined size of the thread supply has been regained. If the sensor D serves as an axially adjustable reference sensor, it will detect at which moment the supply V reaches a predetermined reference position on the storage surface S.

The feed element X is driven synchronously with the winding member W so as to advance the thread supply in the direction of the sensor D (arrow 15). The feed element X consists, for example, of an inclined wobbling disk or of projections protruding outwardly between the fingers E and moving back and forth periodically.

FIG. 2 and 3 show, in an enlarged representation, how the sensor D scans the thread Y or the thread supply V.

The scanning of the thread Y is carried out in a passage area P below which a cavity 1 is provided in the thread storage and feed device F, said cavity 1 being filled with lints and lint tufts L from the thread or with extraneous dirt when the machine is in operation. In the longitudinal direction of the thread Y, the fingers E are provided as support means on both sides of the passage area P, the thread Y extending. freely between said fingers E in each winding. Above the passage area P, the sensor D is provided, said sensor D having arranged therein a light source 2, e.g. light-emitting diode, in a channel 8 of a housing 7 in such a way that it will direct light beams 4 into said passage area P at an acute angle of incidence alpha. A receiver 3, e.g. a photodiode, is arranged in the housing 7, again in a channel 8, at the side of the light source 2 when seen in the longitudinal direction of the thread Y, said receiver 3 being oriented approximately perpendicularly to the thread Y. A shield element 9, which has e.g. a smooth and light-absorbing surface 10 and which covers the cavity 1 with respect to the sensor D at least in the passage area P, is arranged on the side of the thread Y facing away from the light source 2.

The light 4 falls onto the surface 10 at the incident angle alpha. Although the surface 10 is a light-absorbing, e.g. blackened, surface, it will still produce reflected light 5 from the light 4, said reflected light bypassing the receiver 3 laterally at an exit angle (beta). The surface 10 is of such a nature and arranged in such a way that the reflected light produced from the light 4 by said surface 10 will not under any circumstances fall on the receiver 3, whereas the thread Y will, due to its three-dimensional shape and its irregular surface, produce reflected light emitted in all directions; a component 6 of said reflected light, which is represented by a dotted line, falls onto the receiver 3 arranged approximately perpendicularly above the area in which the light 4 falls onto the surface 10. The thread Y can also be scanned transversely to its longitudinal direction, as has been indicated in FIG. 3 by the broken line.

The windings of the thread Y in the thread supply V are, for the purpose of cleaning, e.g. in direct contact with the surface 10 of the shield element 9. The surface 10 may, however, also be arranged below the thread Y at a small distance therefrom, so that only fibres 14 of the thread will sweep over the surface 10 and clean said surface permanently. By the way, the surface 10 is, as has been indicated at 11, smooth so as to produce the smallest possible frictional resistance to the thread Y and, as far as possible, no reflected light or only reflected light which bypasses the receiver.

In FIG. 2 and 3, the surface 10 is flat. It is, however, just as well imaginable to produce the surface 10 as a surface cambering in one direction or in the opposite direction in order to guarantee a uniform thread contact, or, if the surface cambers in the thread feeding direction 15 (FIG. 3), in order to guarantee that only one or only a few thread windings sweep over the surface 10 in the passage area and keep it thus clean.

The shield element 9 can be mounted in different ways. It is, for example, imaginable to fasten said shield element 9 to the fingers E or to one finger E. Alternatively, the shield element 9 may also be fastened to the storage surface core, which stands still during operation.

In FIG. 2 and 3, scanning is effected approximately in the longitudinal direction of the thread or transversely thereto. It is, however, just as well imaginable to select an arbitrary scanning direction (arrangement of the light source 2 and of the receiver 3 relative to the longitudinal direction of the thread).

In FIG. 4 and 5, a different embodiment is shown, in the case of which the thread Y is supported by a finger E of the storage surface in the passage area P supervised by the sensor D. Said finger E has a profiled structural design comprising edges 12 projecting upwards on the sides of said finger as well as a central depression 13 so that the areas of contact with the windings of the thread Y will be small. The shield element 9 is accommodated in said depression 13. The surface 10 is in contact with the thread Y, or it is, relative to said thread Y, which is supported by the lateral edges 12, displaced downwards to such an extent that only the fibres 14 of the thread will clean the surface.

An arrangement comprising the light source 2 and the receiver 3 is shown, in the case of which the light 4 is, in a direction opposite to the feed direction 15 of the thread supply V, directed such that it falls at an oblique angle into the passage area P and the receiver 3 is arranged approximately perpendicularly above the area in which the light 4 falls onto the surface 10. In the case of this arrangement, too, reflected light 5 from the surface 10 is guided such that it bypasses the receiver 3, whereas a reflected light component 6 from the thread Y will fall onto said receiver 3, provided that the thread has arrived at the passage area P. The light H may just as well be directed into the passage area P in the feed direction 15.

Also this embodiment uses, just as the embodiment shown in FIG. 1, a feed element X for producing the thread feed motion, whereby the thread supply V will be advanced. Instead of using a feed element X, it is, however, just as well imaginable to oscillatingly move the finger E in FIG. 4 and 5 in such a way that the windings will be advanced by the movements of said finger, optionally even with interspaces between the individual windings. The sensor D will then scan e.g. the foremost winding of the thread Y so as to find out whether said foremost winding is present or absent or whether it has reached the reference position in the passage area P.

In FIG. 6, it is indicated that the upper side of the finger E according to FIG. 4 is provided with the light-absorbing, smooth surface 10, consisting e.g. of an applied coating 16. In the case of this embodiment, not even reflected light of the finger E will influence the sanning in any way. The thread or the fibres of the thread will clean the surface 10 automatically.

The shield element 9 shown in FIG. 1 to 5 is a simple, economy-priced black plastic plate, which consists of polyester or polyethylene and which has a smooth, flat surface 10, said polyester or polyethylene being tinted black. However, the shield element 9 may just as well consist of a material which allows the light 4 coming from the light source 2 to pass and which is opaque in the opposite direction, approximately like a semireflecting mirror. This would result in a particularly strong light absorption on the side facing the light source, whereas reflected light directed from the back of the shield element 9 onto the receiver 3 would be shielded off. A shield element 9 consisting of so-called light-collecting plastic material may be used as well; this shield element 9 largely absorbs light falling onto its surface 10 and emits said light by total internal reflection at the lateral edges with a direction which is uncritical for the receiver 3. Fundamentally, any material may be used, which, in spite of a low-friction surface, is strongly light-absorbing and, optionally, totally reflectionless.

I claim:

1. In combination, an optical sensor for detecting the presence or absence of a thread or a thread supply which is circumferentially wound on and urged through a predetermined thread passage area of a drum-shaped storage surface of a rod or finger cage of a thread storage and feed device, the wound thread being urged through the predetermined thread passage area transversely to a longitudinal axis of the thread, the optical sensor comprising:

a light source which emits a light beam towards the thread passage area of the thread;

a receiver oriented such that light reflected in the thread passage area will fall onto said receiver;

a plate-like shielding element arranged on a side of said thread passage area remote from said light source and said receiver, the wound thread contacting a light-absorbing surface of said plate-like shielding element upon moving through the thread passage area, said shielding element being arranged between said receiver and other surfaces of the thread storage and feed device which are located on a side of said shielding element remote from said receiver and light source, and arranged between said receiver and objects such as lint and dust which accumulate within the rod or finger cage, said shielding element preventing said other surfaces and objects from reflecting undesirable light to said receiver; and said receiver being positioned outside the range of scattered light reflected by said light-absorbing surface so as to respond only to scattered light reflected from the wound thread within the thread passage area.

2. The combination according to claim 1, wherein the light-absorbing surface has, with respect to an incident angle ($\alpha$) of the light beam emitted from the light source, a predetermined reflected light orientation, and that the light absorbing surface is arranged such that the reflected light orientation is directed to bypass the receiver.

3. The combination according to claim 1, wherein the shielding element includes a plastic plate, and the light-absorbing surface of the shielding element has the properties of being smooth, black and flat, or cambering.

4. The combination according to claim 1, wherein the shielding element is arranged between the thread passage area and a cavity which is provided in the rod or finger cage below the thread passage area, and that the shielding element shields off said cavity with respect to the light source and the receiver.

5. The combination according to claim 1, wherein the light-absorbing surface is flat, the light beam emitted from the light source is directed towards the thread passage area at an oblique incident angle ($\alpha$) approximately transversely to the longitudinal axis of the wound thread when viewed along the longitudinal axis of the wound thread, and the receiver is arranged adjacent the light source and approximately perpendicularly above an area where the light beam strikes the light-absorbing surface.

6. The combination according to claim 1, wherein the light-absorbing surface is flat, the light beam from the light source is directed at an oblique incident angle ($\alpha$) towards the thread passage area substantially in a direction along the longitudinal axis of the wound thread, and the receiver is arranged adjacent the light source when viewed in a direction transverse of the longitudinal axis of the wound thread and approximately perpendicularly above an area where the light beam strikes the light-absorbing surface.

7. The combination according to claim 1, wherein the wound thread is in contact with the light-absorbing surface.

8. The combination according to claim 1, wherein the rod or finger cage includes means for supporting the wound thread extending between the shielding element and the receiver and light source, the wound thread extending through the thread passage area freely and in a stretched condition, and the wound thread contacting the light-absorbing surface only with fibers projecting from the thread.

9. The combination according to claim 1, wherein the shielding element includes means for permitting light travelling in a first direction away from the light source to pass through the shielding element, and means for preventing light travelling in a second direction toward the receiver from passing through the shielding element from the other surfaces and objects.

10. A thread storage and feed device having a rod or finger cage for supporting a thread or thread supply which is circumferentially wound on and urged through a predetermined thread passage area of a drum-shaped storage surface of the rod or finger cage, the wound thread being urged through the predetermined thread passage area transversely to a longitudinal axis of the thread, the device comprising:

a light source positioned radially outward from the drum-shaped storage surface, said light source emitting a light beam toward the thread passage area;

a receiver positioned adjacent said light source radially outward from the drum-shaped storage surface, said receiver being oriented such that light reflected from the wound thread in the thread passage area will fall onto said receiver;

a plate-like shielding element positioned radially adjacent the drum-shaped surface on a side of the thread passage area remote from said light source and said receiver so that the wound thread is disposed therebetween, said plate-like shielding element having a light-absorbing surface which faces the light source and the receiver and which also faces the thread passage area so that the wound thread passes in front of the light-absorbing surface upon moving through the thread passage area; and said receiver being further positioned outside the range of scattered light reflected by said light-absorbing surface so as to respond only to scattered light reflected from the wound thread within the thread passage area.

* * * * *